United States Patent [19]

Gallay et al.

[11] 4,054,351

[45] Oct. 18, 1977

[54] CONNECTION BETWEEN A DEVICE IN A METALLIC SHEATH AND A TRANSFORMER

[75] Inventors: Maurice Gallay, Aix-les-Bains; Jacques Fournier, Lyon, both of France

[73] Assignees: Alsthom-Savoisienne S.A., Saint-Ouen; Delle-Alsthom S.A., Villeubranne, both of France

[21] Appl. No.: 758,749

[22] Filed: Jan. 12, 1977

[30] Foreign Application Priority Data

Jan. 16, 1976 France ..... 76.01154

[51] Int. Cl.[2] ..... H01R 3/04

[52] U.S. Cl. ..... 339/117 R; 174/18; 174/19; 339/118 R

[58] Field of Search ..... 339/117 R, 117 P, 118 R; 174/18 X, 19 X, 21 R

[56] References Cited

U.S. PATENT DOCUMENTS 3,538,483 12/1968 Dyer ..... 339/118 R X

FOREIGN PATENT DOCUMENTS 2,223,801 3/1973 France ..... 174/18

603,037 6/1948 United Kingdom ..... 174/18

*Primary Examiner*—Roy Lake

*Assistant Examiner*—DeWalden W. Jones

*Attorney, Agent, or Firm*—Sughure, Rothwell, Mion, Zinn, and Macpeak

[57] ABSTRACT

This electrical connection relates to an electrical link between a device in a metallic sheath insulated by a gas under pressure and a transformer insulated by a dielectric liquid. The connection comprises a jacket separating the interior volume of the transformer from that of the device and having a frustoconical insulating wall shielding the capacitor bushing and penetrating into the sheath. The insulating wall comprises on the outside of its base a flange having two concentric annular surfaces, one coming into contact with the sheath of the device and defining a junction plane between the interior volume of the device under gas pressure and the atmosphere, the other defining with another part a junction plane between the interior volume of the jacket filled with dielectric liquid and the atmosphere.

4 Claims, 1 Drawing Figure

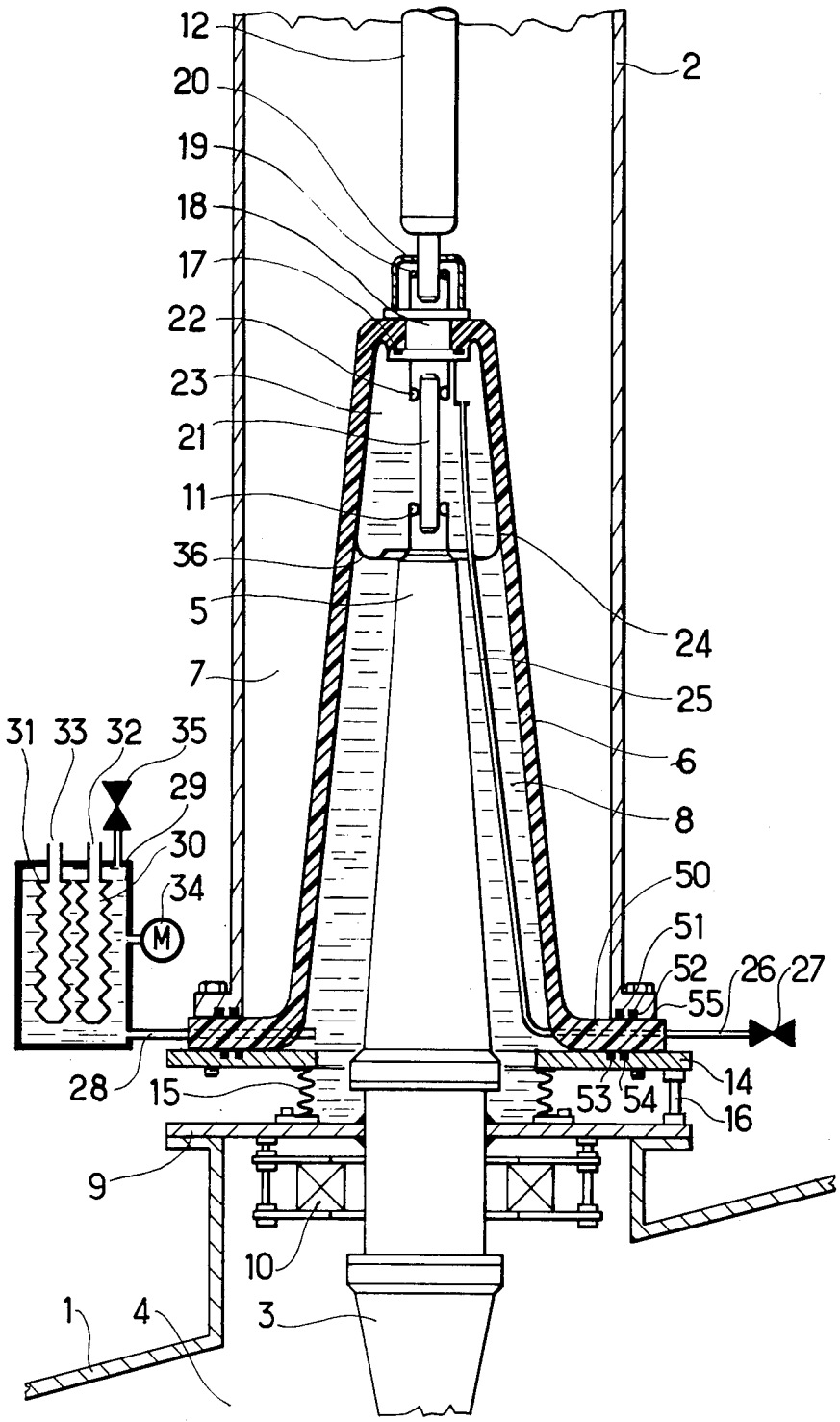
12
20
19
18
17
22
23
21
11
36
5
7
31
33
32
35
29
30
34
M
28
15
9
10
1
4
3
2
24
25
6
8
50
51
52
26
27
55
14
53
54
16

CONNECTION BETWEEN A DEVICE IN A METALLIC SHEATH AND A TRANSFORMER

BACKGROUND OF THE INVENTION

The invention relates to a connection between a device in a metallic sheath insulated by a gas under pressure and a transformer insulated by a dielectric liquid similar to those described in French Pat. No. 2,223,801. Such a connection comprises a jacket separating the interior volume of the transformer from that of the device, the interior volume of the jacket being filled with a dielectric liquid at a pressure close to atmospheric pressure and delimited by two surfaces: an interior surface and an exterior surface, the interior surface being formed by the exterior surface of a capacitor bushing fixed by a disc to the tank of the transformer and the exterior surface, constituted mainly by a frustoconical insulating wall which shields the capacitor bushing, is inserted in the metallic casing of the device and can be fixed by its base to that casing.

In the examples of connections described in French Pat. No. 2,223,801 the frustoconical insulating wall is fixed by its base to an intermediate plate integral with the metallic casing of the device. A metallic bellows completes the exterior surface delimiting the volume of the jacket. It is disposed round the capacitor bushing and fixed by one end to the disc of that capacitor bushing which is integral with the tank of the transformer and by the other end to the intermediate plate. Surfaces of the base of the frustoconical insulating wall and of the intermediate plate in contact with each other make the interior volume of the jacket communicate with the interior volume of the device in a metallic sheath. A large-diameter annular seal is placed between these surfaces to provide sealing and to avoid gas leakages from the device towards the interior volume of the jacket.

Preferred embodiments of the present invention prevent leakage of the insulating gas into the interior volume of the jacket by means of a modification to the shape of the insulating wall's base in the above-mentioned seal.

SUMMARY OF THE INVENTION

The present invention provides a connection between a device in a metallic sheath insulated by a gas under pressure and a transformer insulated by a dielectric liquid comprising a jacket separating the interior volume of the transformer from that of the device, the interior volume of the jacket being filled with a dielectric liquid at a low pressure and delimited by two surfaces, an interior surface constituted by the exterior surface of a capacitor bushing, and an exterior surface formed mainly by a frustoconical insulating wall shielding the capacitor bushing and penetrating into the metallic casing, wherein the frustoconical insulating wall comprises at its base an external flange having two concentric annular surfaces, one of them contacting the metallic sheath of the device and defining a sealing plane between the interior volume of the device under gas pressure and the atmosphere and the other one of the annular surfaces defining with another part a sealing plane between the interior volume of the jacket filled with the dielectric liquid and the atmosphere.

Other characteristics and advantages of the invention will become apparent from the accompanying claims and from the following description of an embodiment given by way of example. This description will be given with reference to the sole FIGURE of the accompanying drawing which shows an axial cross-section of a connection according to the invention between a transformer insulated in oil and an electric line in a metallic sheath insulated by sulphur hexafluoride under pressure.

DESCRIPTION OF THE PREFERRED EMBODIMENT

In the FIGURE, 1 is the tank of the transformer, 2 is the metallic sheath of the connection linking the transformer to the device. The capacitor bushing is an "oil-oil" capacitor bushing. It comprises an end portion 3 situated in the oil 4 of the transformer inside the tank 1. This end 3 of the capacitor bushing has standard dimensions for the transformer and the voltage considered. The other end 5 of the capacitor bushing outside the tank 1 is, for a given voltage, much shorter than that of a normal oil-air capacitor bushing. The contours delimited by ends 3 and 5 comprise the active part of the capacitors and the insulators which enclose the bushing. The proper distribution of voltage on the exterior surface of the top end 5 ensures a proper distribution of the dielectric stresses at a frustoconical insulating wall 6 which separates the surrounding insulating gas 7, e.g. sulphur hexafluoride from the oil of an intermediary volume constituting a jacket 8 contained between the capacitor bushing 5 and the insulating wall 6. This volume is relatively small as only a short distance separates the capacitor bushing 5 from the wall 6. The wall 6 is provided to withstand the difference in pressure between the insulating gas 7 (generally several bars in normal operation) and the oil in the jacket 8 which in normal operation is substantially equal to atmospheric pressure and does not exceed a few hundreds of millibars in exceptional conditions.

This jacket 8 is delimited by two surfaces, an interior surface and an exterior surface. The interior surface is formed by the exterior surface of the top end 5 of the capacitor bushing emerging from the tank 1 of the transformer. The exterior surface is constituted mainly by the frustoconical insulating wall 6 inserted by its pointed end into the metallic sheath 2 of the line, insulated by sulphur hexafluoride and made integral with said casing at its base. The surface is completed by a bellows tube 15 which surrounds the lower portion of the top end 5 of the capacitor bushing. The bellows tube 15 is fixed in a fluid-tight manner at one end to a disc 9 and at its other end to the base of the conical insulating wall 6 by means of an intermediate plate 14. The disc 9 of the capacitor bushing 3-5 can be provided with a magnetic circuit 10 for a current transformer. The end 5 of the capacitor bushing is electrically connected to the conductor 12 of the electric line by means of a conductive part 18 passing through the top of the frustoconical insulating wall 6. The jacket 8 includes a draining system formed by a tube 25 of insulating material ending at its upper part near the top of the insulating wall 6 and by a pipe 26 passing through the base of the insulating wall 6 and connecting the tube 25 to a drain cock 27 disposed on the outside. The jacket 8 also communicates with an expansion chamber 29 placed outside the sheath 2, enabling its internal pressure to be made substantially equal to external pressure.

The form of the base of the frustoconical insulating wall 6 comprises an external flange 50 sandwiched between the rim 55 of the metallic sheath 2 and the intermediate plate 14. The surface of the flange in contact with the rim 55 of the metallic sheath 2 defines a sealing plane extending between the interior volume of the metallic sheath 2 and the outside atmosphere. Sealing is ensured in this sealing plane by two concentric sealing gaskets 51 and 52. The surface of the flange 50 in contact with the intermediate plate 14 defines another joint plane extending between the interior volume of the wall 6 and the outside atmosphere. Sealing is ensured by two concentric sealing gaskets 53 and 54.

The sealed bellows tube 15 can be metallic or insulating, according to the dispositions chosen for earthing the various casings of the unit. Detachable jacks 16 can be installed to facilitate assembly and are then removed when the device is put into service. The frustoconical insulating wall 6 is fixed in a fluid-tight manner at 17 to the part 18 which is connected to the conductor 12 by the contact fingers 19 protected by spark-arresters 20. The connection between upper contact fingers 11 of the capacitor bushing 5 and the part 18 is ensured resiliently e.g. by means of a conductive rod 21 suspended from the part 18 by a device which is not shown and in contact with the fingers 22, themselves fixed to the part 18.

For this vertical capacitor bushing, any of the compressed gas 7 in the sheath 2 which passes into the oil of the jacket 8, will rise towards the upper zone 23 of the jacket 8. As the conductor 21 and the contact fingers 11 and 22 are of small diameter, or may have sharp ridges and as they are liable to be in a zone 23 full of gas and not of oil, a metallic electrostatic screen 24 is disposed inside the insulating cone 6 in order to obtain a more homogeneous electric field.

The gas accumulated at 23 is removed through the insulative tube 25, the pipe 26 which passes through the plate 14 and the drain cock 27.

In the expansion chamber, the expansion of the oil of the jacket 8 is allowed by deforming one or several deformable, variable volume members 30, 31 whose interior is brought to atmospheric pressure by the pipes 32, 33. As long as the deformable members 30 and 31 are not reduced to zero by the expansion of the oil, the pressure which prevails in the jacket 8 and in the expansion chamber 29 is substantially equal to atmospheric pressure.

But if sealing is faulty between the space 7 under gas pressure and the jacket 8, the gas in the space 7 will enter the jacket 8 because its pressure is higher. The gas will accumulate in the upper zone 23 of the frustoconical insulating wall 6 will take the place of the oil, cause the oil to flow back towards the tank 29 and cause the deformation of the deformable members 30 and 31. When the interior volumes of members 30 and 31 are reduced to zero, the pressure will increase at the upper part 23 of the frustoconical insulating wall 6. The presence of gas will be detected by the increase in pressure at 23 measured by a contact gauge or a direct reading gauge 34 installed on the expansion chamber 29. The permissible increase in pressure is in practice generally relatively low and by way of an indication is in most cases in the order of a few tens to a few hundreds of millibars. When the gauge operates or indicates an increase in pressure, the space 23 is drained by means of the valve 27 and if necessary oil can be added through the pipe and the cock 35. A quantity of gas may have been dissolved in the oil; in the case of sulphur hexafluoride, the coefficient of solubility as a function of the temperature of this gas in oil is negative and the increase in the operation temperature reduces the quantity of gas dissolved in the oil.

The expansion chamber 29 is elastic but fluid-tight and enables the presence of gas to be detected; this is very desirable for vertical or inclined capacitor bushings, especially for the highest voltages, since the gas accumulates at the top of the frustoconical insulating wall 6 at a point where the electric stresses are high. To avoid unusual stresses due to accumulations of gas on the outside of the screen 24, small orifices 36 are provided, this preventing the gas from forming small pockets between the screen 24 and the frustoconical insulating wall 6.

Due to the disposition of the base of the frustoconical insulating wall 6, there is no danger of the gas leaking from the interior volume of the sheath 2 into the jacket 8 by flowing round the base of the wall 6. Indeed, if there is a leakage of gas at the base of the frustoconical insulating wall 6, the gas can merely leak away.

Without going beyond the scope of the invention, dispositions can be changed in particular the shape and the orientation of the sealing planes around the flange 50 surrounding the base of the conical insulating wall 6.

What we claim is:

1. A connection between a device in a metallic sheath insulated by a gas under pressure and a transformer insulated by a dielectric liquid, said transformer including a capacitor bushing and said sheath concentrically surrounding the upper end of said bushing, said connection comprising: a jacket separating the the transformer from that of the device, the interior volume of the jacket being filled with a dielectric liquid at a low pressure and delimited by two surfaces, an interior surface constituted by the exterior surface of the capacitor bushing, and an exterior surface formed mainly by a frustoconical insulating wall shielding the capacitor bushing and penetrating into the metallic sheath, the frustoconical insulating wall comprising, at its base, an external flange having two concentric annular surfaces, one of said annular surfaces contacting the metallic sheath of the device and defining a sealing plane between the interior volume of the device under gas pressure and the atmosphere and the other of the annular surfaces defining with another part a sealing plane between the interior volume of the jacket filled with the dielectric liquid and the atmosphere.

2. A connection according to claim 1, wherein said other part is an intermediate plate installed at one of the ends of a metallic bellows disposed round the base of the capacitor bushing and fixed by its other end to a disc of said capacitor bushing.

3. A connection according to claim 1, wherein annular sealing gaskets are disposed in said sealing planes.

4. A connection according to claim 2, wherein annular sealing gaskets are disposed in said sealing planes.

* * * * *